United States Patent [19]

Moody et al.

[11] Patent Number: 4,632,247

[45] Date of Patent: Dec. 30, 1986

[54] TOOL FOR THE AUTOMATIC INSTALLATION OF DISCRETE CABLE TIES PROVIDED ON A CONTINUOUS RIBBON OF CABLE TIES

[75] Inventors: Roy A. Moody, Flossmoor; John J. Bulanda, New Lenox, both of Ill.

[73] Assignee: Panduit Corp., Tinley Park, Ill.

[21] Appl. No.: 671,642

[22] Filed: Nov. 15, 1984

Related U.S. Application Data

[62] Division of Ser. No. 444,495, Nov. 24, 1982.

[51] Int. Cl.[4] ..... B65D 69/00; B65D 71/00

[52] U.S. Cl. ..... 206/343; 24/16 R; 206/820

[58] Field of Search ..... 24/16 R, 16 PB, 17 R, 24/17 A, 17 B, 17 AP, 30.5 W, 30.5 P, 150 FP, 115 H, 114.5; 140/93 A, 93.2, 57, 123.6; 206/338-348, 820

[56] References Cited

U.S. PATENT DOCUMENTS

| | | | |
|---|---|---|---|
| 2,811,702 | 10/1957 | Narozny | 206/820 |
| 3,103,666 | 9/1963 | Bone | 227/67 |
| 3,431,548 | 3/1969 | Busler | 206/820 |
| 3,759,435 | 9/1973 | Bone | 227/67 |
| 3,774,756 | 11/1973 | Carlile et al. | 206/348 |
| 3,864,008 | 2/1975 | Bakermans et al. | 206/343 |
| 3,946,769 | 3/1976 | Caveney et al. | 140/93.2 |
| 3,976,108 | 8/1976 | Caveney et al. | 140/93 A |
| 4,004,618 | 1/1977 | Turek | 140/93.2 |
| 4,079,485 | 3/1978 | Collier et al. | 24/16 |
| 4,359,070 | 11/1982 | Hidassy et al. | 140/93 A |
| 4,417,656 | 11/1983 | Kato | 206/820 |

*Primary Examiner*—William Price
*Assistant Examiner*—Jimmy G. Foster
*Attorney, Agent, or Firm*—Charles R. Wentzel; Mark D. Hilliard

[57] ABSTRACT

Ribbon of cable ties including a strip portion extending the length of the ribbon having a plurality of cable ties connected thereto by respective connecting tabs. The strip portion having an alignment mechanism adapted to cooperate with the guide mechanism in a dispenser to accurately position the ribbon laterally in the dispenser mechanism.

12 Claims, 10 Drawing Figures

TOOL FOR THE AUTOMATIC INSTALLATION OF DISCRETE CABLE TIES PROVIDED ON A CONTINUOUS RIBBON OF CABLE TIES

This is a division of application Ser. No. 444,495, filed Nov. 24, 1982.

BACKGROUND OF THE INVENTION

The present invention relates generally to the application of cable ties to wire bundles or the like and specifically to a continuous ribbon of cable ties for use with a tool that automatically dispenses, conveys and applies discrete cable ties to wire bundles or the like.

Prior automatic cable tie installation tools have utilized a cartridge to contain a number of discrete cable ties and provide the cable ties sequentially to a dispenser mechanism in the tool. The use of a cartridge to feed discrete cable ties to an automatic cable tie installation tool presents inherent limitations and operational difficulties that limit the efficiency of the tool.

Any tool utilizing a cartridge has the inherent limitation of only being able to apply as many cable ties as the cartridge is designed to hold. Application by the tool of all the ties in the cartridge necessitates the exchange of the empty cartridge for a loaded cartridge of the manual refilling of the empty cartridge. Practical design constraints dictated by the dimensions of the cable ties and the need for a portable and easily operable automatic tool have limited the number of cable ties carried in an individual cartridge to approximately one hundred cable ties.

Prior tools also require the cable ties to be loaded into each cartridge in a specific and consistent orientation, requiring careful and time consuming manipulation of individual cable ties during the cartridge loading operation.

Compounding the above described inefficiencies is the fact that cartridge supplied tools inherently have complex mechanisms to allow the detachable mounting of a cartridge and to sequentially dispense cable ties from the cartridge. Such mechanisms must meet close tolerances in manufacture and fit and must be carefully operated and maintained in order to provide error free operation. Due to these constraints, prior tools have failed to operate flawlessly during the attachment of new cartridges. The tools often will jam during the loading of a cartridge requiring the waste of operator time to unjam and properly reload the tool.

All of the above problems contribute to a loss of overall efficiency in the prior automatic cable tie installation tools; a significant portion of an operator's time being devoted to the loading of cartridges instead of to the application of cable ties.

Additional problems inherent in supplying cable ties by cartridge include the increased costs due to manufacture, storage and disposal of the cartridge.

SUMMARY OF INVENTION

It is an object of the present invention to provide a ribbon of cable ties mounted on an alignment strip that ensures error free loading, alignment and long operation of a cable tie installation tool.

These and other objects, together with the advantages thereof over existing prior art forms, which will become apparent from the following specification, are accomplished by means hereinafter described. In general, the ribbon of the present invention which is utilized in an automatic cable tie installation tool includes a strip portion extending the length of said ribbon, a plurality of cable ties each having a locking head portion and a strap portion. The strip portion being connected to the heads of each cable tie by a tab. Affixed along the length of the strip portion are a plurality of alignment projections that provide accurate alignment reference guidance for alignment of the ribbon with the automatic cable tie installation tool.

DESCRIPTION OF THE PREFERRED EMBODIMENT

Figure 1:
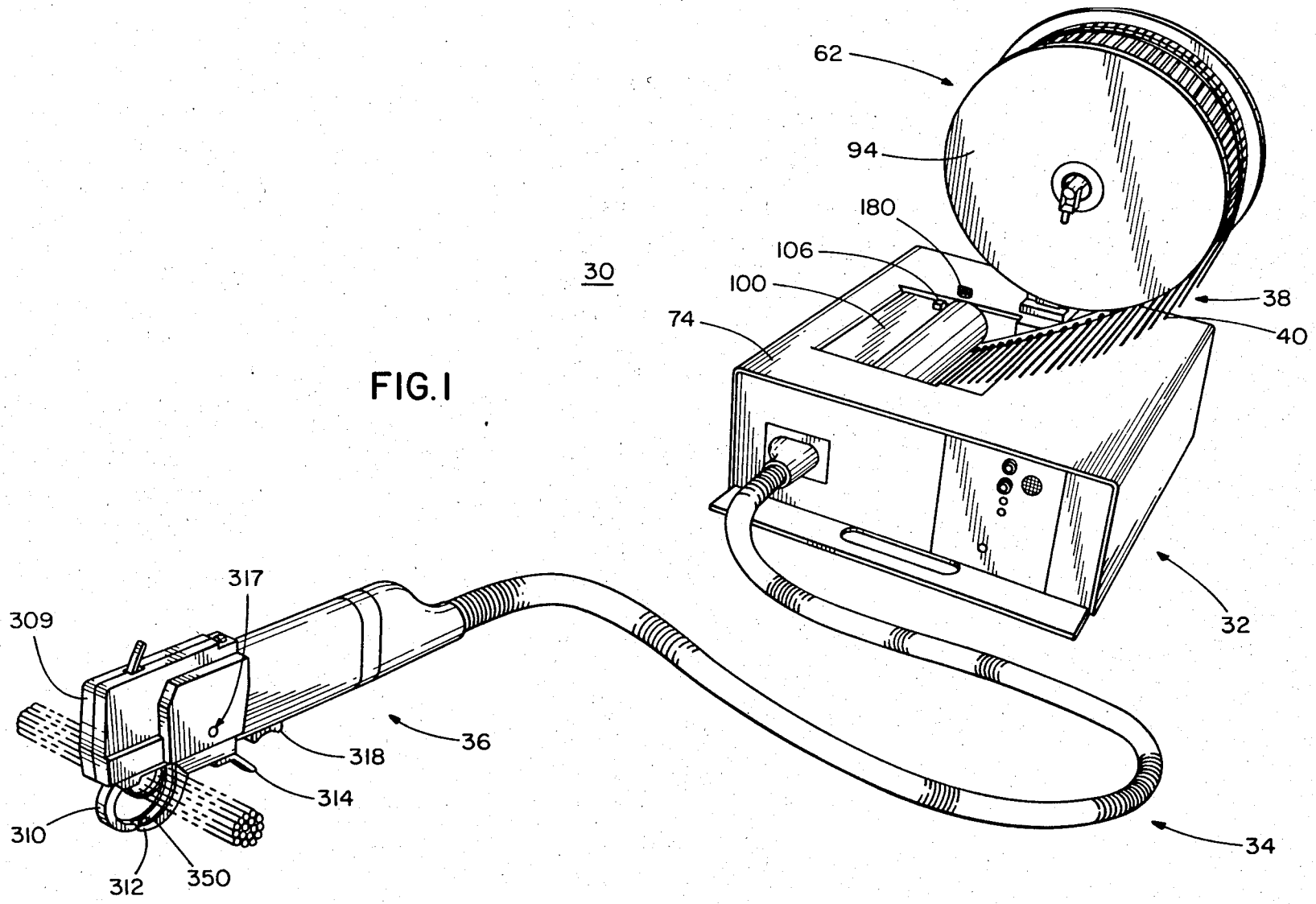
FIG. 1 is a perspective view of an automatic cable tie installation tool embodying the concept of the present invention, the automatic tool having a dispenser mechanism, a conveyance mechanism and a remote tool mechanism.

An automatic cable tie installation tool is generally indicated by the numeral 30 in the accompanying drawings. As best seen in FIG. 1, the automatic tool 30 includes a dispenser mechanism 32, a conveyance mechanism 34 and a remote tool 36.

The dispenser mechanism 32 accepts a ribbon 38 of cable ties 40 embodying the concept of the present invention and sequentially dispenses individual ties 40 to conveyance mechanism 34. The conveyance mechanism 34 delivers the individual ties 40 to remote tool 36. Remote tool 36 then positions each tie 40 around a bundle of wire or the like, tensions tie 40 to a predetermined value and then severs the tail of tie 40.

Figure 2:
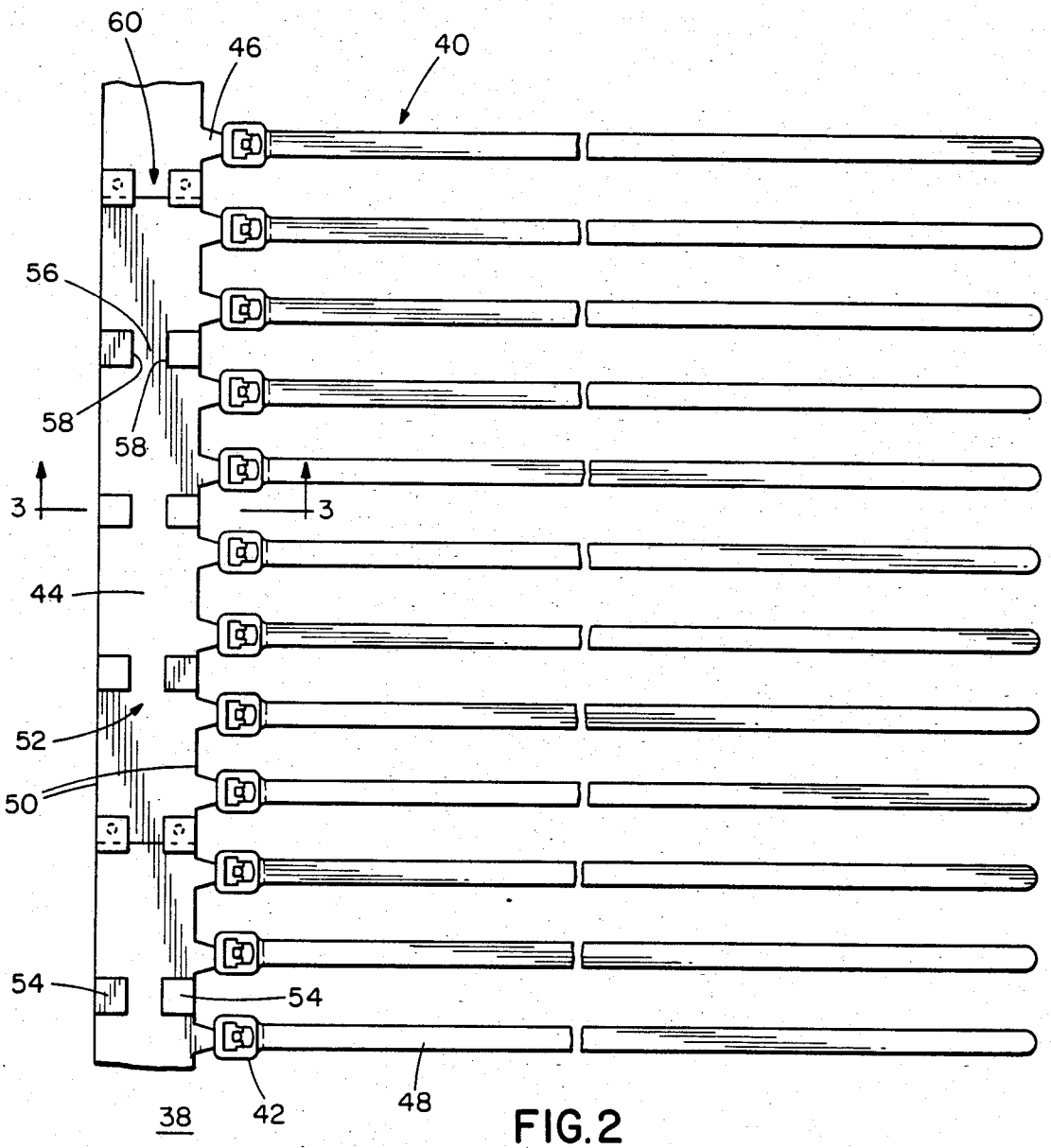
FIG. 2 is a top view of a planar ribbon of cable ties embodying the concept of the present invention.
Figure 3:
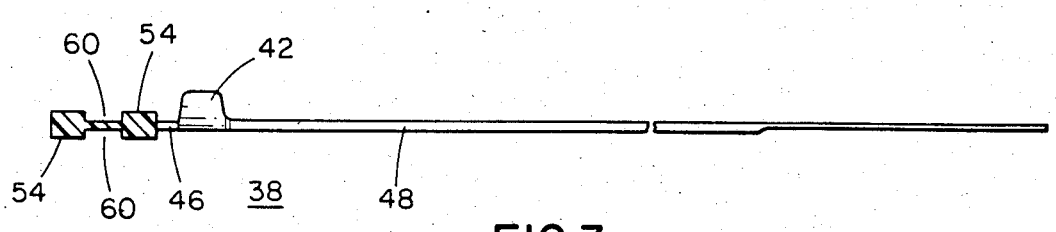
FIG. 3 is a sectional view of the ribbon in FIG. 2 taken along line 3—3 of FIG. 2.

The ribbon 38, as best seen in FIGS. 2 and 3, includes a plurality of cable ties 40 each mounted at their heads 42 to strip portion 44 by a tab 46. The ties 40 are equally spaced along the length of strip portion 44 with each cable tie's medial longitudinal axis being in parallel disposition to each other tie 40 and each tie 40 forming a right angle with the longitudinal axis of strip portion 44.

Figure 9:
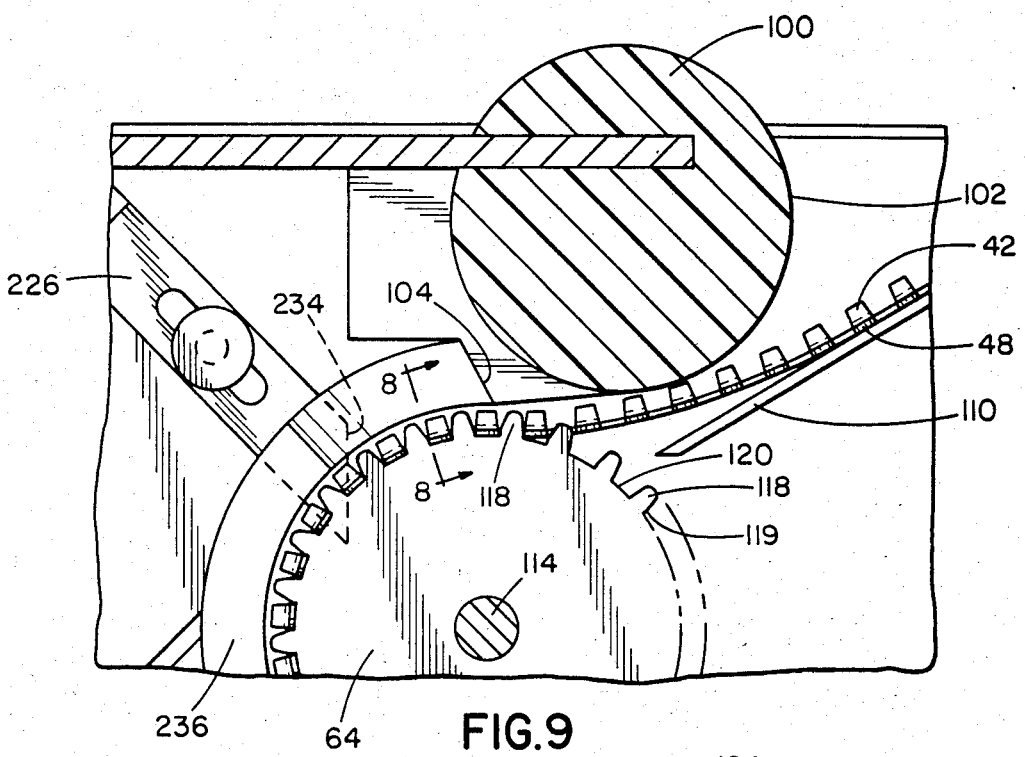
FIG. 9 is a partial sectional view of the dispenser mechanism of FIG. 5 taken along line 9—9 of FIG. 5.

The ties 40 are of normal one piece construction having a locking head 42 and a strap 48 that inserts into head 42 to be locked therein. As seen in FIG. 9, the head 42 of each tie 40 tapers from a greater width in the plane of strap 48 to a smaller width in a parallel plane above the strap 48. The thickness of each head 42 of each tie 40 is approximately three times the thickness of strap 48. The strap 48 being approximately equal in thickness to strip portion 44 and being located substantially in the same plane. Each head 42 thus projects above the strap 48 and strip portion 44; the heads 42 of the plurality of ties 40 in ribbon 38 forming a projecting discontinuous ridge running the length of ribbon 38.

The ties 40 are connected to strip portion 44 by tabs 46. Each tab 46 is located in the same plane as strip portion 44 and is of approximately the same thickness. The tabs 46 are trapezoidal in shape, tapering from a wider end adjacent strip portion 44 to a narrower end adjacent head 42.

The strip portion 44 is defined by two parallel edges 50; the inner edge 50 being contiguous to tabs 46 and the outer edge 40 having no substantial discontinuities. The wide of strip portion 44 is approximately twice the length of head 42. The length of strip portion 44 is defined by the length of ribbon 38. The thickness of strip portion 44 is sized dependent upon its material, to provide sufficient flexibility to allow ribbon 38 to be coiled on a dispensing reel but with sufficient rigidity to define a substantially planar ribbon 38.

Positioned on both planar sides and along the length of strip portion 44 are alignment guides 52. Alignment guides 52 each include two square projecting surfaces 54. The surfaces 54 are formed in line with each abutting a different edge 50 of strip portion 44. The surfaces 54 are each approximately one third the width of strip portion 44, the two surfaces 54 together defining a channel area 56 interposed between the two surfaces 54 that is approximately one third the width of strip portion 44. The surfaces 54 have opposing inner sides that define two alignment edges 58. The alignment edges 58 are colinear with the respective alignment edges 58 of each successive alignment guide 52 on strip portion 44 and are parallel to each other, defining a discontinuous alignment channel 60 running the length of strip portion 44. The alignment edges 58 allow accurate lateral alignment of ribbon 38, alignment edges 58 providing opposing alignment surfaces thus allowing positioning of ribbon 38 in both lateral directions. Successive alignment guides 52 are equally spaced along the length of strip portion 44 having two ties 40 interposed therebetween.

In preferred form, each alignment guide 52 on one planar side of the strip portion 44 is juxtaposed with a reflecting alignment guide 52 on the opposite planar side of the strip portion 44, thus defining two alignment channels 60 positioned on opposing planar sides of strip portion 44.

Ribbon 38 is preferably manufactured as a one piece thermoplastic ribbon; ties 40, tabs 46 and strip portion 44 all being integrally molded of the same material. Manufacture of ribbon 38 is effected by molding incremental lengths of ribbon 38 and joining the distal end of strip portion 44 of each incremental length of ribbon 38 to the distal end of strip portion 44 of a successive incremental length of ribbon 38. In preferred construction, the connection of the incremental lengths of ribbon 38 is accomplished as each new incremental length of ribbon 38 is molded; the trailing end of strip portion 44 of the last molded incremental length of ribbon 38 being held within the incremental ribbon mold, while the strip portion 44 of the next succeeding incremental length of ribbon 38 is fixedly molded to this trailing end. The strip portion 44 of each incremental length of ribbon 38 can be molded with bores disposed proximate the trailing end of each strip portion 44 whereby material from the next succeeding molded incremental length of ribbon 38 will fill the bores and provide a secure connection between the contiguous incremental lengths of ribbon 38. It should be understood that other methods of securely mounting cable ties to an aligning strip also are within the concept of the present invention. For example, discretely manufactured cable ties may be secured to a carrier strip in the same structural configuraation as described above by adhesive or by interference fit between each tie and the carrier strip.

Figure 4:
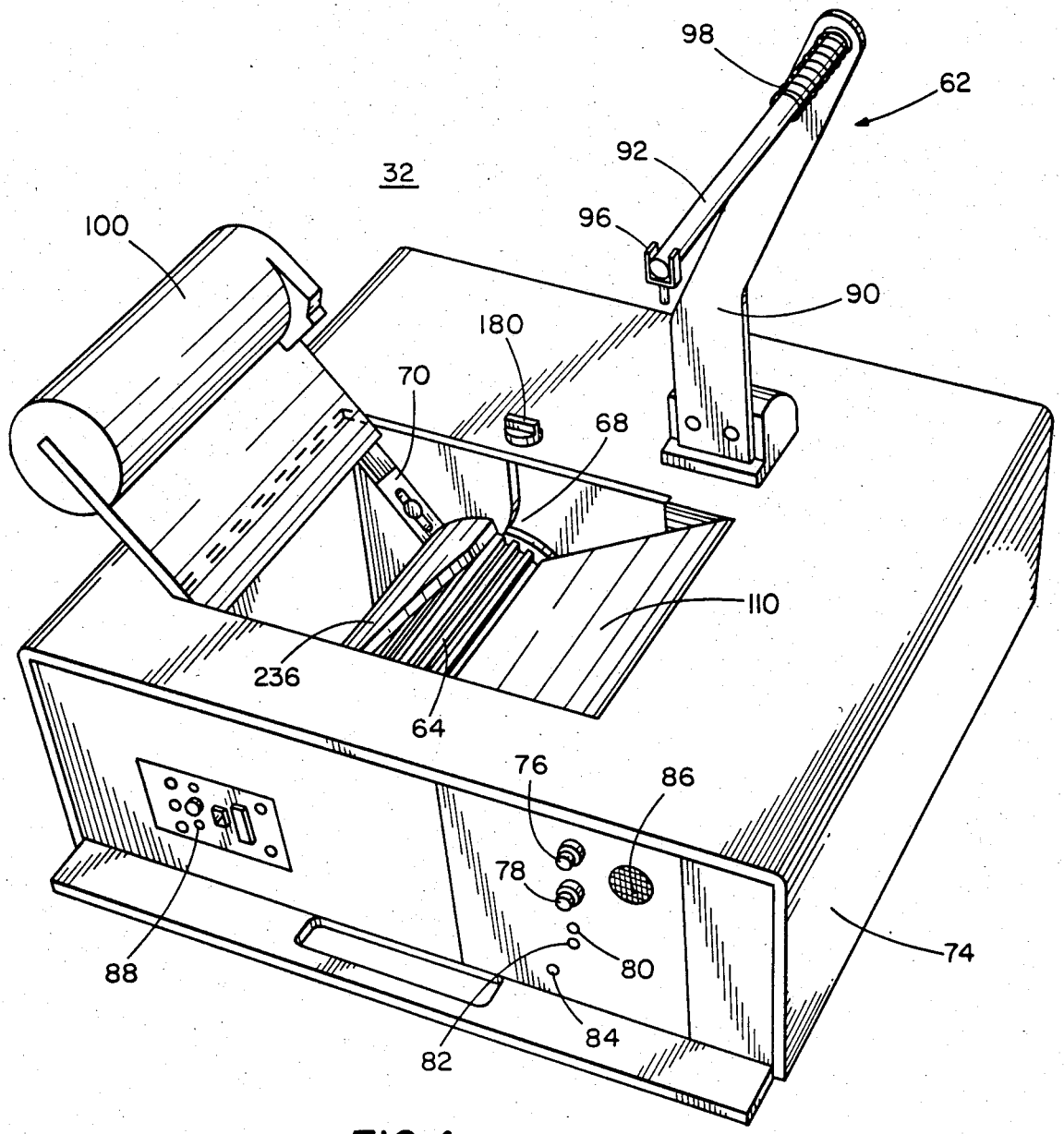
FIG. 4 is a perspective view of the dispenser mechanism of FIG. 1 with the dispenser's load door being disposed in the open position.
Figure 5:
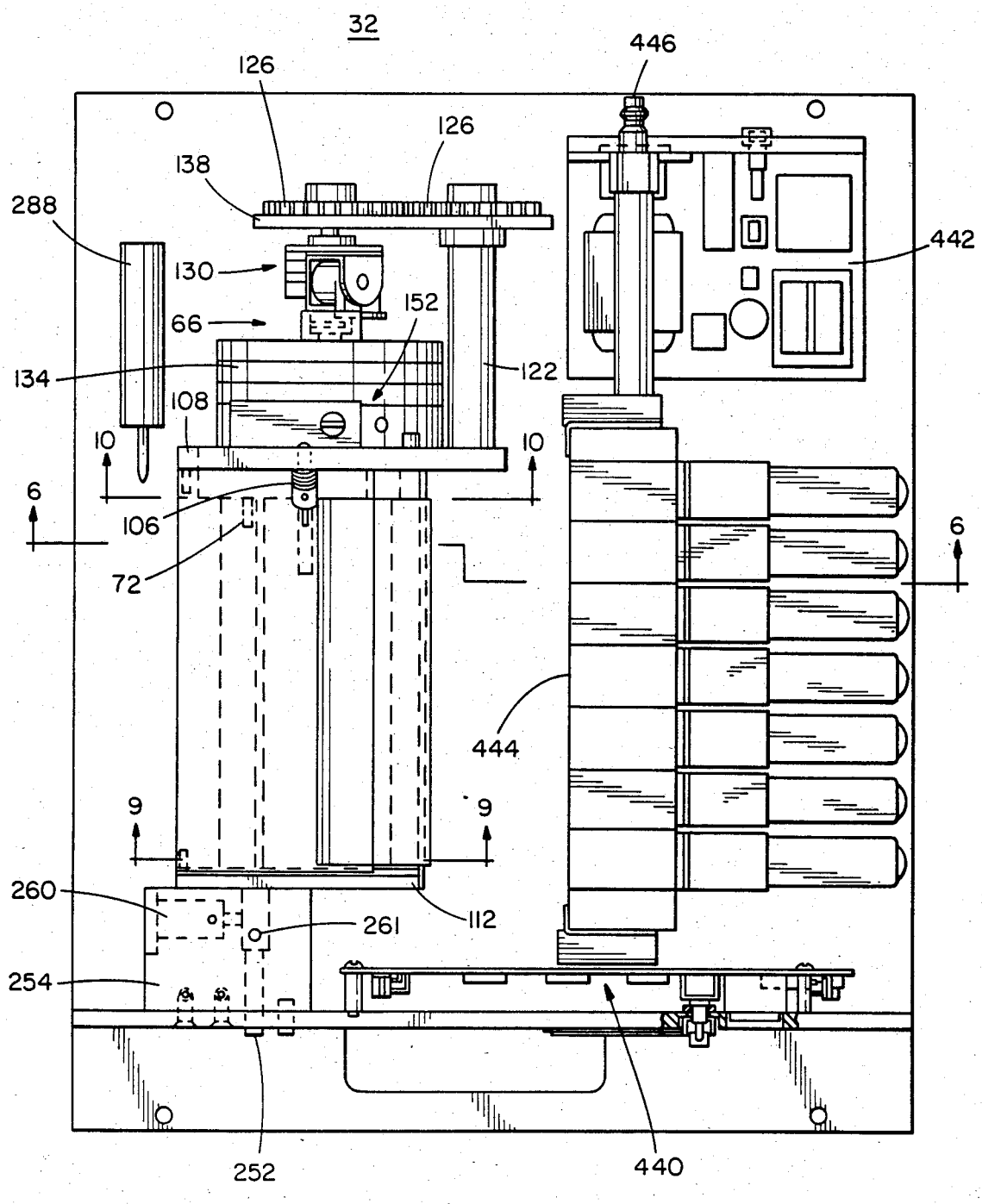
FIG. 5 is a top view of the dispenser mechanism of FIG. 4 as seen with the dispenser housing removed.

Referring now to FIGS. 1, 4 and 5, dispenser mechanism 32 generally includes a reel mechanism 62 for providing ribbon 38 to dispenser mechanism 32, a grooved cylinder 64 that accurately positions and carries the individual ties 40, an index mechanism 66 that drives the cylinder 64, a guide mechanism 68 that cooperates with the strip portion 44 of ribbon 38 to accurately position the ribbon 38 in dispenser mechanism 32, a knife 70 that separates individual ties 40 from ribbon 38, and a transfer mechanism 72 that delivers discrete separated ties 40 upon demand.

The dispenser mechanism 32 is enclosed in housing 74. The housing 74 having a reset button 76, a load button 78, a light emitting diode 80 for indicating a check loading condition, a light emitting diode 82 for indicating a check hose/empty condition, a light emitting diode 84 for indicating a power on condition and an audible warning buzzer 86; all proximately located on the front side of housing for ease of inspection by the operator of automatic tool 30. Also located on the front of housing 74 is a connector port 88 designed to mate with conveyance mechanism 34.

The reel mechanism 62, as best seen in FIGS. 1 and 4, is mounted on dispenser housing 74 of dispenser mechanism 32. The reel mechanism 62 includes a bracket 90 mounted to dispenser housing 74 by suitable fasteners at its lower end and having a reel arm 92 non-rotatably mounted in a bore at its upper end. The reel arm 92 is positioned with its axis parallel to the axis of cylinder 64. The reel arm 92 is a smooth cylindrical bar sized to accept and rotatably mount reel 94 that carries the coiled ribbon 38. The distal end of reel arm 92 carries a removable retaining pin 96 which limits the outward movement of mounted reel 94. A spring 98 is coaxially carried on reel arm 92, being sized to apply a tensioning force against reel 94 to restrain free rotation of reel 94 while allowing the cylinder 64 to withdraw ribbon 38 from reel 94. The reel 94 is mounyed on reel arm 92 having strip portion 44 placed inwardly and aligned with guide mechanism 68.

As seen in FIGS. 4, 5 and 9 a pivotally mounted dispenser load door 100 is mounted above cylinder 64. The door 100 has a substantially cylindrical forward contour 102 that helps guide ribbon 38 into cylinder 64 and an angular shaped back contour 104 that mates with cover 236. The door 100 can be pivoted upwardly from cylinder 64 to facilitate loading and downwardly into position over the cylinder 64 to act as a guide for ribbon 38 and to shield cylinder 46 from the introduction of foreign objects. Mounted proximate door 100 is an electrical load door safety switch (not shown) that provides a signal indicating whether door 100 is open or closed. The load door 100 is provided with a latch 106, as seen in FIG. 5, that selectively locks the door 100 in a closed position by insertion of a pin through a first mounting wall 108. The load door safety switch can be positioned in a known manner to sense whether door 100 is locked in the closed position. Also providing guidance to ribbon 38 is an inclined ramp 110 of housing 74 that projects from the top of housing 74 towards cylinder 64. The ramp 110 helps support and guide ribbon 38 as it is drawn into mating engagement with cylinder 64 from reel mechanism 62.

Figure 7:
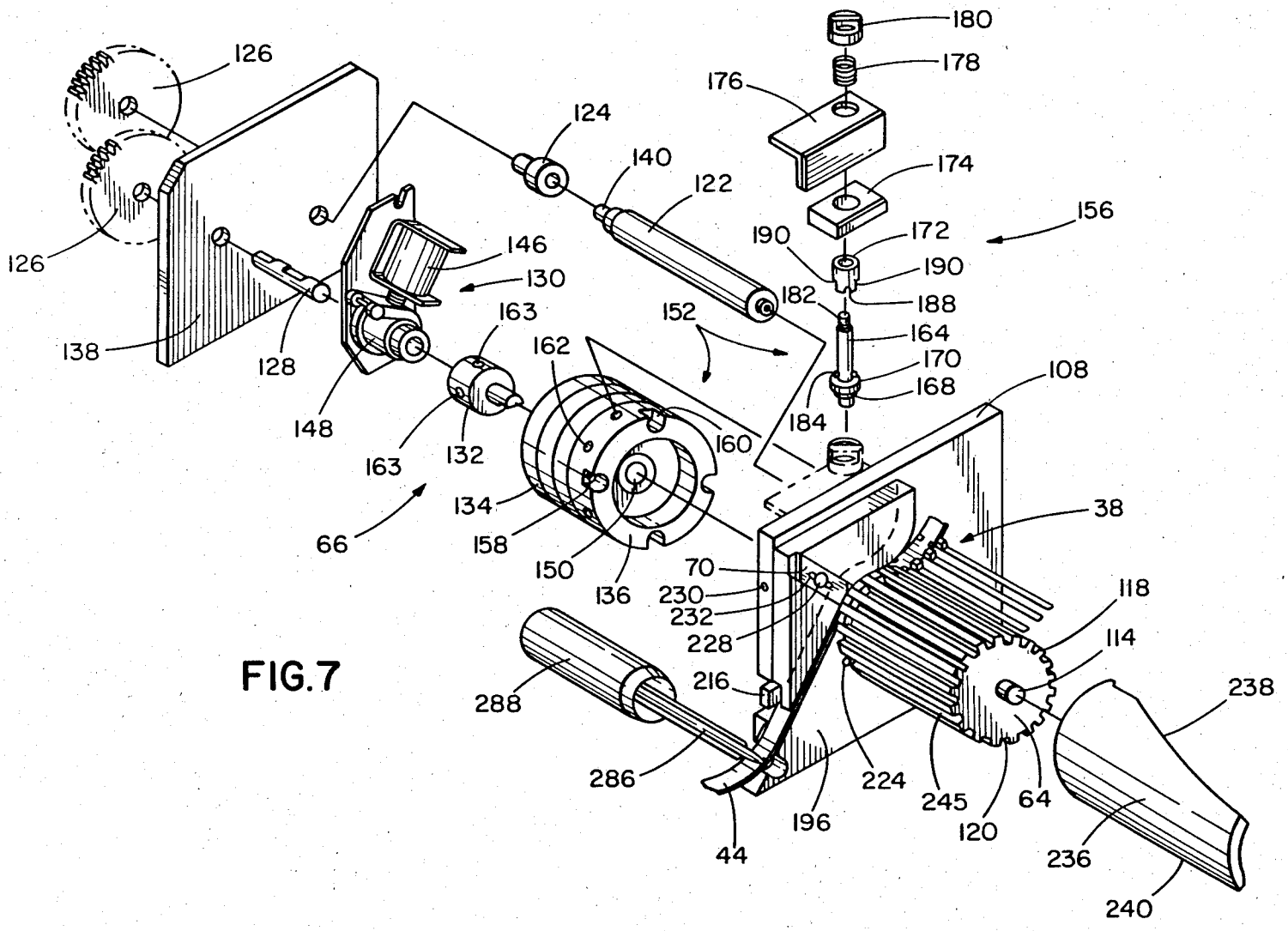
FIG. 7 is an exploded perspective of the dispenser mechanism of FIG. 5.

As seen in FIGS. 5 and 7, grooved cylinder 64 is rotatably mounted between first moutning wall 108 and a second mounting wall 112 on bearings (not shown) by an axle 114. The axle extends through a bore in first mounting wall 108 and presents a splined end (not shown) by which it is secured to index mechanism 66. The cylinder 64 has a plurality of splines 118 that define a plurality of grooves 120. The grooves 120 run the length of cylinder 64 being slightly greater in depth than the height of heads 42 of ties 40 and being slightly longer than the length of ties 40. As seen in FIG. 9, splines 118 present a contour having flat surface portions 119 that facilitate the mating acceptance of heads 42 of ties 40; the width of the grooves 120 at their deepest point being slightly wider than the greatest width of tie 40. Ribbon 38 is driven by the mating interaction of heads 42 of ties 40 with grooves 120; grooves 120 accurately longitudinally positioning and driving the head 42 of each cable tie 40, thereby longitudinally positioning and driving ribbon 38.

The index mechanism 66 includes a dispenser air motor 122, a gear adaptor 124, drive gears 126, drive shaft 128, single revolution clutch 130, clutch drive adaptor 132, planetary gear assembly 134 and an index ring 136. The index mechanism 66 rotates the cylinder 64 in accurate increments of fractions of one revolution in order to sequentially carry ribbon 38 to knife 70 and transfer mechanism 72. In preferred construction the cylinder 64 presents twenty-five grooves equally spaced around its circumference, each of which is sized relative to ribbon 38 to carry one tie 40. The cylinder 64 in FIG. 7 being depicted having nineteen grooves for clarity. Thus in order to sequentially present each tie 40 to the stationary transfer mechanism 72, cylinder 64 must be accurately rotated 1/25 of one complete revolution.

Figure 8:
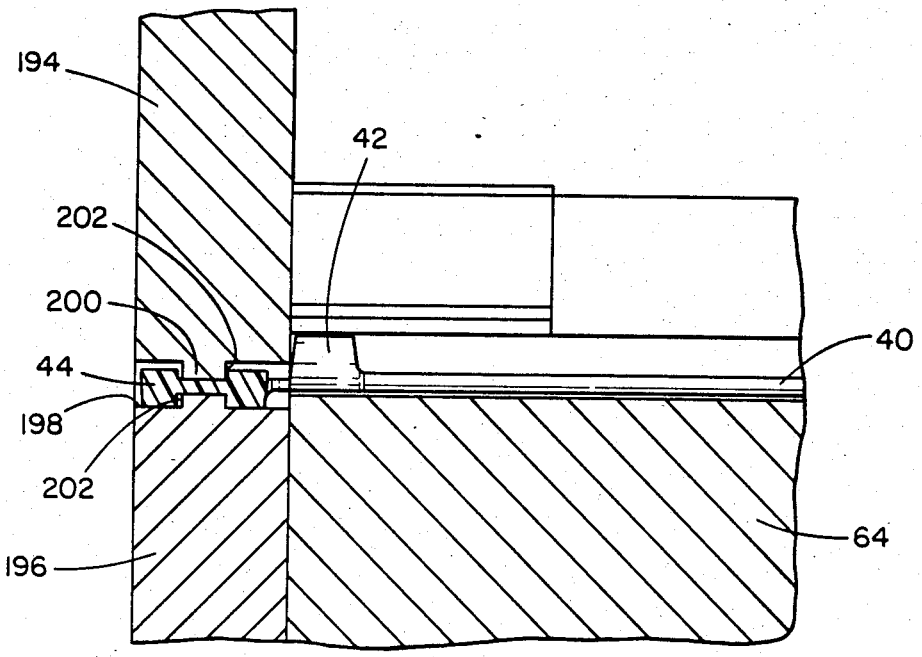
FIG. 8 is a partial sectional view of the ribbon and the upper and lower guide plates of the dispenser mechanism as taken along line 8—8 of FIG. 9.
Figure 10:
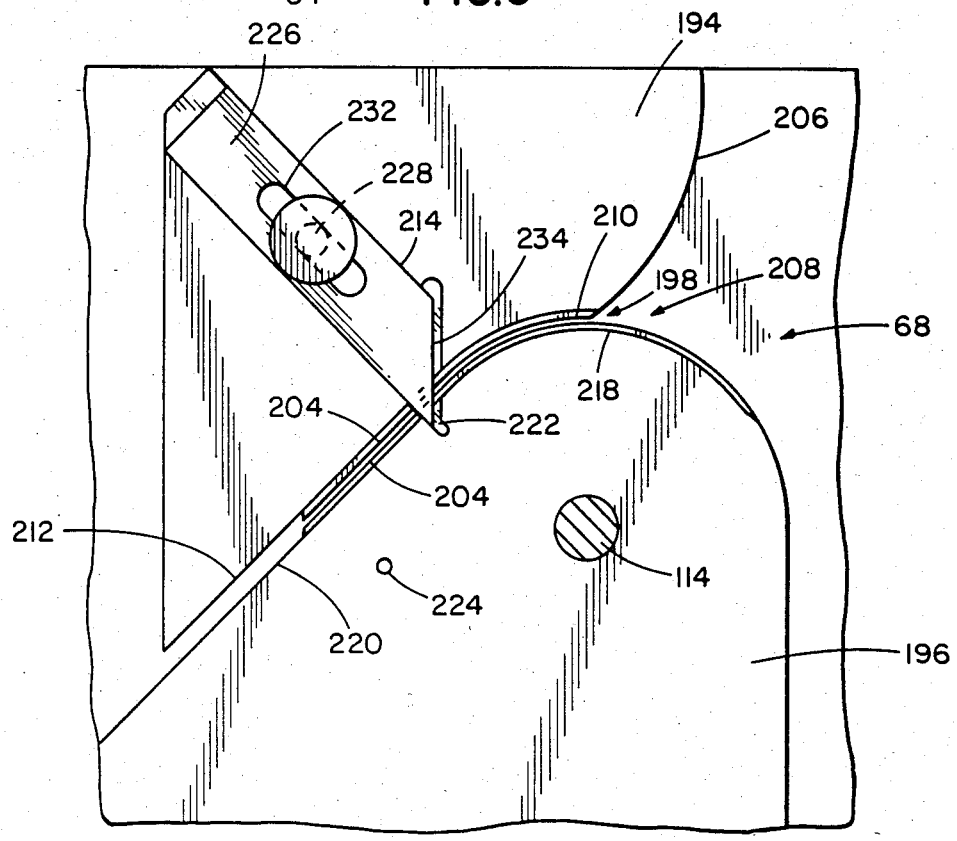
FIG. 10 is a partial sectional view of the upper and lower guide plates of the dispenser mechanism of FIG. 5 as taken along line 10—10 of FIG. 5.

Referring now to FIGS. 7, 8 and 10, guide mechanism 68 includes an upper guide plate 194 and a lower guide plate 196 that together matingly define an I-shaped channel 198 having flanges 200 that each provide alignment edges 202 sized to matingly carry and position strip portion 44 of ribbon 38. The upper and lower guide plates 194 and 196 are positioned parallel to and affixed to first mounting wall 108, adjacent cylinder 64. The upper and lower guide plates 194 and 196 have complimentary edges 204 that together define the path of ribbon 38 and strip portion 44.

As seen in FIGS. 7 and 10, upper guide plate 1984 is positioned above the cylinder 64, its edge 204 having a forward bluntly curved portion 206 that is positioned away from lower guide plate 194 to define a mouth 208 to initially accept and guide ribbon 38 into position with cylinder 64 and channel 198, an intermediate portion 210 that follows the curve of cylinder 64 to position ties 40 thereon and an inclined portion 212 projecting downwardly defining the path of strip portion 44 after ties 40 have been severed. In the face of upper guide plate 194 adjacent cylinder 64 is a knife kerf 214. Knife kerf 214 projects downwardly at approximately a forty-five degree angle to the horizontal plane, in a line that intersects the center of axle 114 of cylinder 64. The lower corner of upper guide plate 194 presents a notch 216 onto which is mounted a photoelectric strip sensor positioned to detect the absence of strip portion 44 of ribbon 38.

The lower guide plate 196 is positioned below upper guide plate 194 its edge 204 having a forward portion 218 that approximates the inner circumference of grooves 120 and an inclined portion 220 that matingly follows edge 204 of upper guide plate 194. The lower guide plate 196 also has a knife kerf 222 positioned in line with upper guide plate's knife kerf 214 on its surface adjacent the cylinder 64 and an orifice 224 of transfer mechanism 72 that is positioned to align with one of the grooves 120 when the groove 120 is in the horizontal plane that intrsects cylinder axle 114.

Knife 70 includes a blade 226 adjustably mounted in knife kerf 214 by screw 228 that attaches blade 226 to a rod (not shown). The rod is slidably mounted in a bore through first mounting wall 108 and upper guide plate 194 that communicates with the knife kerf 214. A set screw 230 is mounted transverse to the rod in first mounting wall 108 in such a manner to interferingly secure the rod from movement. Positional adjustment of knife 70 is accomplished by loosening set screw 230 and repositioning the rod. The blade 226 has a medical mounting slot 232 for accepting the screw 228 and an angular cutting edge 234 for severing tie 40 from ribbon 38. The knife blade 226 is positioned transverse to the ribbon 38, lying in a plane parallel to the face of upper and lower guide plates 194 and 196, between upper and lower guide plates 194 and 196 and cylinder 64. The angled tip of cutting edge 234 projects past the channel 198, presenting an angled cutting edge 234 normal to the outer end of head 42 of tie 40. Movement of tie 40 past the angled cutting edge 234 results in a slicing cutting action which cleanly separates tie 40 from ribbon 38.

The accurate lateral positioning of heads 42 of ties 40 relative to the blade 226 is ensured by the aligning cooperation of alignment guides 52 on strip portion 44 of ribbon 38 and alignment edges 202 of I-shaped channel 198 as seen in FIG. 8. Additionally, the shape of tab 46, being smaller in width near head 42 of tie 40 facilitates the separation of head 42 from tab 46 close to the head 42. Fine adjustments to the position of blade 226 relative to head 42 of tie 40 can also be made by set screw 230, allowing the operator to compensate for inherent tolerance variations. Thus the present invention ensures that the discrete cable ties 40 provided by dispenser mechanism 32 present a cable tie 40 having a substantially smooth head 42.

Positioned in mating proximity to cylinder 64 is cover 236. Cover 236 is a partial section of a cylindrical shell having its inner diameter sized to mate with the outer diameter of cylinder 64. Cover 236 is equal in length to cylinder 64 and extends from a first edge 238 at approximately the top of cylinder 64 to second edge 240 approximately one hundred and forty degrees and around the cylinder 64. The first edge 238 has an angled countour, as seen in FIGS. 4 and 7, which facilitates the guidance of heads 42 of ties 40 into grooves 120 of grooved cylinder 64. The first edge 238 is angled to contact heads 42 of ribbon 38 before it contacts straps 48 of cable ties 40. Thus, as grooved cylinder 64 rotates drawing ribbon 38 inward, first edge 238 initially guides and inserts head 42 of each incoming tie 40 into its respective groove 120 and subsequently guides each strap 48 into the same groove 120.

Figure 6:
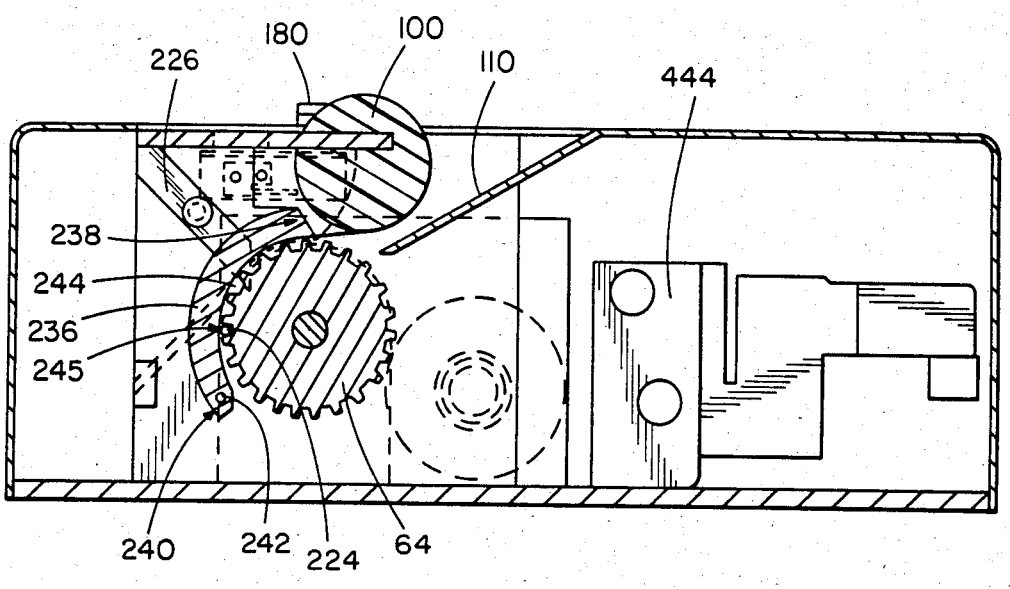
FIG. 6 is a sectional view of the dispenser mechanism of FIG. 5 taken along line 6—6 of FIG. 5.

The cover 236 is mounted on a hinge 242, as seen in FIG. 6, to allow cover 236 to be pivoted outwardly from cylinder 64 to facilitate the removal of jammed material from cylinder 64. The cover 236 does not extend past the bottom of cylinder 64, thus severed ties 40 passing beyond transfer mechanism 72 are eventually dropped from the bottom of cylinder 64 and do not interfere with continued functioning of dispenser mechanism 32. The cover 236 is positioned near enough to cylinder 64 to non-interferingly allow movement of cylinder 64 while sealingly covering a number of grooves 120 to therein define a number of channels 244.

What is claimed is:

1. A ribbon of cable ties for installation by a cable tie installation tool, comprising:

a strip portion extending the length of said ribbon;

a plurality of cable ties each having a locking head portion and a strap portion;

connecting means for connecting said strip portion to the heads of said cable ties; and alignment means integral with said strip portion being positioned along the length of said strip portion, said alignment means comprising two projecting surfaces each respectively being located towards opposing edges of the planar surface of said strip portion, said projecting surfaces having inner opposing sides that define two alignment edges at least one of said alignment edges being positioned parallel to a longitudinal axis of said strip portion, whereby said alignment means is adapted to cooperate with means in the tool to laterally position said ribbon in the tool for accurate removal of individual cable ties from said strip portion.

2. A ribbon as set forth in claim 1, wherein each of said projecting surfaces is discontinuous, having a plurality of in line constituent projections spaced along the length of said strip portion, the successive inner sides of said projections respectively defining each of said alignment edges, said alignment edges together defining an alignment channel that cooperates with the means in the tool to laterally align said ribbon in both lateral directions.

3. A ribbon as set forth in claim 2, wherein said alignment means are affixed to both opposing planar surfaces of said strip portion.

4. A ribbon as set forth in claim 3, wherein said projections positioned on one planar surface of said strip portion are juxtaposed with corresponding projections positioned on the opposite planar surface of said strip portion.

5. A ribbon as set forth in claim 4, wherein said connecting means comprise a plurality of tabs each having a trapezoidal shape, tapering from a wider end adjacent said strip portion to a narrower end adjacent the respective head of each of said cable ties, said narrower end facilitating separation of said cable tie from said tab, close to said head.

6. A ribbon as set forth in claim 5, wherein:

each of said projections of said alignment means is located adjacent the opposing respective edges of said strip portion, said projections each having a width one third the width of said strip portion;

said cable ties are equally spaced along the length of said strip portion; and said ribbon is integrally molded for thermoplastic.

7. A ribbon of cable ties for use in an automatic cable tie installation tool having a longitudinally grooved cylinder, the grooves of the cylinder being adapted to engage and contain individual cable ties in order to position said ribbon longitudinally and to carry said ribbon for removal of individual cable ties from said ribbon, comprising:

a strip portion extending the length of said ribbon, having at least one alignment edge positioned parallel to the length of said strip portion for accurate lateral alignment of said ribbon relative to the grooved cylinder of the automatic cable tie installation tool;

a plurality of cable ties each having a locking head and a strap portion;

connecting means for connecting said strip portion to each of said locking heads, said locking heads being accurately spaced along the length of said strip portion to cooperate and mate with the grooves of the grooved cylinder, said strap forming an angle with the longitudinal line of said strip portion that positions said cable ties to cooperate with the grooved cylinder and allow mating engagement of said cable ties with the grooved cylinder of the automatic cable ties installation tool, said heads being adapted to position and carry said ribbon on the grooved cylinder in the longitudinal direction; and alignment means including two surfaces projecting from the surface of said strip portion and running the length of said strip portion, defining two parallel alignment edges for providing accurate alignment reference guidance for lateral alignment of said ribbon, said projecting surfaces being discontinuous each having a plurality of in line constituent projections spaced along the length of said strip portion, inner opposed sides of said projections defining said parallel alignment edges, said sides being collinear with respective sides of successive projections.

8. A ribbon as set forth in claim 7, wherein said projecting surfaces are respectively located towards opposing edges of the planar surface of said strip portion, said alignment edges defining an alignment channel, said alignment channel being adapted to cooperate with a means in the cable tie installation tool to align said ribbon laterally.

9. A ribbon as set forth in claim 8, wherein said alignment means are affixed to both opposing planar surfaces of said strip portion.

10. A ribbon as set forth in claim 9, wherein said projections positioned on one planar side of said strip portion are juxtaposed with reflecting projections positioned on the opposite planar surface of said strip portion.

11. A ribbon as set forth in claim 10, wherein each of said projections of said projecting surfaces is located adjacent the opposing respective edges of said strip portion, said projections each having a width one third the width of said strip portion.

12. A ribbon as set forth in claim 11, wherein said ribbon is integrally molded thermoplastic.

13. A ribbon of cable ties for installation by a cable tie installation tool, comprising:

a strip portion having opposing planar sides and first and second lateral edges extending the length of said ribbon;

a plurality of cable ties each having a locking head portion and a strap portion;

means for connecting said strip portion at said second lateral edge to the heads of said cable ties; and alignment means integrally formed on at least one of said planar sides of said strip portion and extending the length of said ribbon including two parallel alignment edges which are disposed parallel to the length of said ribbon and are spaced inwardly of said first and second lateral edges, said alignment means further including surfaces formed on and spaced from said strip portion, each respective alignment edge adjoining one of said surfaces and said strip portion, whereby said alignment means is adapted to cooperate with means in the tool to laterally position said ribbon in the tool for accurate removal of individual cable ties from said strip portion.

14. A ribbon as set forth in claim 13, wherein each of said surfaces is discontinuous along the length of the strip, successive inner edges of said surfaces being collinear to define said alignment edges, said alignment edges together defining an alignment channel that cooperates with means in the tool to laterally align said ribbon in both lateral directions.

15. A ribbon as set forth in claim 14, wherein said alignment means are affixed to both of said opposing planar sides of said strip portion.

16. A ribbon as set forth in claim 15, wherein said surfaces positioned on one planar side of said strip portion are juxtaposed with corresponding surfaces positioned on the opposite planar side of said strip portion.

17. A ribbon as set forth in claim 16, wherein said means for connecting include a plurality of tabs each having a trapezoidal shape tapering from a wider end adjacent said strip portion to a narrow end adjacent the respective head of each of said cable ties whereby said narrow end facilitates separation of said cable tie from said tab, close to said head.

* * * * *

UNITED STATES PATENT AND TRADEMARK OFFICE

CERTIFICATE OF CORRECTION

PATENT NO. : 4,632,247

DATED : December 30, 1986

INVENTOR(S) : Roy A. Moody and John J. Bulanda

It is certified that error appears in the above-identified patent and that said Letters Patent are hereby corrected as shown below:

In the title of the invention, delete "TOOL FOR THE AUTOMATIC INSTALLATION OF DISCRETE CABLE TIES PROVIDED ON A".

Column 1, line 26, change "of" to --or--.

Column 3, line 15, change "40" to --50--.

Column 7, claim 6, line 63, change "for" to --of--.

Signed and Sealed this

Twenty-eighth Day of April, 1987

*Attest:*

DONALD J. QUIGG

*Attesting Officer*

*Commissioner of Patents and Trademarks*